US006982591B2

(12) United States Patent
Abadeer et al.

(10) Patent No.: US 6,982,591 B2
(45) Date of Patent: Jan. 3, 2006

(54) METHOD AND CIRCUIT FOR COMPENSATING FOR TUNNELING CURRENT

(75) Inventors: Wagdi W. Abadeer, Jericho, VT (US); Jennifer E. Appleyard, Burlington, VT (US); John A. Fifield, Underhill, VT (US); William R. Tonti, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/731,298

(22) Filed: Dec. 9, 2003

(65) Prior Publication Data

US 2005/0122160 A1 Jun. 9, 2005

(51) Int. Cl.
*G05F 1/10* (2006.01)
*G05F 3/02* (2006.01)

(52) U.S. Cl. ..... 327/543; 327/541

(58) Field of Classification Search ..... 327/538, 327/540, 541, 543; 323/315–316
See application file for complete search history.

(56) References Cited

U.S. PATENT DOCUMENTS

| | | | | |
|---|---|---|---|---|
| 5,757,175 | A * | 5/1998 | Morishita et al. | 323/315 |
| 5,808,484 | A * | 9/1998 | Phillips et al. | 327/18 |
| 5,942,934 | A * | 8/1999 | Ngo et al. | 327/540 |
| 6,163,191 | A * | 12/2000 | Miyagi | 327/208 |
| 6,326,800 | B1 | 12/2001 | Kirihata | 324/760 |
| 6,462,527 | B1 * | 10/2002 | Maneatis | 323/315 |
| 6,472,897 | B1 * | 10/2002 | Shyr et al. | 324/765 |
| 6,597,619 | B2 * | 7/2003 | Stubbs et al. | 365/226 |
| 6,844,750 | B2 * | 1/2005 | Hsu et al. | 324/763 |
| 2004/0085845 | A1 * | 5/2004 | Ooishi | 365/226 |
| 2004/0263200 | A1 * | 12/2004 | Persun et al. | 324/768 |

FOREIGN PATENT DOCUMENTS

JP 11126815 A 5/1999

* cited by examiner

*Primary Examiner*—Quan Tra
(74) *Attorney, Agent, or Firm*—Schmeiser, Olsen & Watts; William H. Steinberg

(57) ABSTRACT

A method and circuit for tunneling leakage current compensation, the method including: forcing a current of known value through a tunneling current leakage monitor device to provide a voltage signal; and regulating an on-chip power supply of the integrated circuit chip based on the voltage signal.

17 Claims, 4 Drawing Sheets

METHOD AND CIRCUIT FOR COMPENSATING FOR TUNNELING CURRENT

FIELD OF THE INVENTION

The present invention relates to the field of integrated circuits; more specifically, it relates to a circuit and method for compensating for tunneling leakage currents in an integrated circuit chip.

BACKGROUND OF THE INVENTION

Integrated circuit manufacturing tolerances on critical field effect (FET) device parameters can affect device performance. For example, variations in gate dielectric (often an oxide) thickness, FET channel length and threshold voltage will produce skews in performance and in power consumption creating distributions referred to as fast, nominal and slow process, or alternatively as best-case, nominal and worst-case product corners.

Further, as dielectric thicknesses have decreased, tunneling leakage has become an appreciable fraction of the total integrated circuit power consumption. Tunneling leakage is especially problematic for the best-case or fast process distribution, because the faster devices draw more current than slow devices. In the absence of speed sorting, the speed of integrated circuits is specified at the slowest end of the distribution to insure all manufacturing output can be sold. An integrated circuit with fast processing will therefore be sold for performances slower than its actual capabilities and will conduct the highest amount of gate leakage.

Device dielectric tunneling leakage current can also affect burn-in of integrated circuits. During burn-in, a static voltage that is a multiple of the normal operating voltage of the integrated circuit is applied to the integrated circuit in order to force devices with weak gate dielectrics and other defects to fail. A typical burn-in condition multiplies the normal power supply between 1.1× and 1.5×, which results in a static tunneling current increase. Burn-in power dissipation can be 60 watts compared to about 20 watts at the normal, lower power supply. At these higher burn-in voltages power dissipation of the integrated circuit can be high enough to cause catastrophic failure of both the integrated circuit and the associated burn-in boards and other equipment.

Therefore, a method of compensating for tunneling leakage that will reduce the power consumption of fast integrated circuit chips and the power distribution of integrated circuits chips during burn-in is needed.

SUMMARY OF THE INVENTION

A first aspect of the present invention is a tunneling leakage current compensation circuit, comprising: a current mirror coupled to a tunneling leakage monitor, the tunneling leakage monitor including a tunneling leakage monitoring device, the current mirror adapted to force a tunneling leakage current of the tunneling leakage device to a predetermined current value; and a voltage buffer coupled to the leakage monitor, the voltage buffer adapted to generate an output voltage based on a voltage level developed across the leakage monitoring device when the tunneling leakage current is at the predetermined current value.

A second aspect of the present invention is a method of compensating for tunneling current leakage in an integrated circuit chip, the method comprising: forcing a current of known value through a tunneling current leakage monitor device to provide a voltage signal; and regulating an on-chip power supply of the integrated circuit chip based on the voltage signal.

A third aspect of the present invention is a method of compensating for tunneling current leakage in an integrated circuit chip, the method comprising: providing a current mirror coupled to a tunneling leakage monitor, the tunneling leakage monitor including a tunneling leakage monitoring device, the current mirror for forcing a tunneling leakage current of the tunneling leakage device to a predetermined current value; and providing a voltage buffer coupled to the leakage monitor, the voltage buffer for generating an output voltage based on a voltage level developed across the leakage monitoring device when the tunneling leakage current is at the predetermined current value.

BRIEF DESCRIPTION OF DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE INVENTION

For the purposes of the present invention, tunneling leakage is defined as both the current flow due to a statistical probability that carriers will pass through a dielectric layer having a voltage applied across the dielectric layer and the current flow through a dielectric layer related to dielectric structure and dielectric faults. A gate capacitor is defined as a capacitor formed from a gate, a gate dielectric and the channel region of an NFET or a PFET and commonly referred to as an NCAP or a PCAP respectively. This definition of a gate capacitor is intended to cover all thin dielectric capacitors formed using a thin dielectric film formed on a semiconductor substrate, wherein the semiconductor substrate is one of the plates of the capacitor.

A fast process or best-case process is defined as a process resulting in an integrated circuit chip having the minimum gate dielectric thickness, shortest channel length and lowest threshold voltage allowed by the manufacturing process specification. A slow process or worst-case process is defined as a process resulting in an integrated circuit chip having the maximum gate dielectric thickness, longest channel length and highest threshold voltage allowed by the manufacturing process specification. A nominal process or nominal case process is defined as a process resulting in an integrated circuit chip having a gate dielectric thickness, a channel length and a threshold voltage centered in the manufacturing process specification. For the purposes of the present invention, the terms slow process and worst-case process may be used interchangeably. For the purposes of the present invention, the terms nominal process and nominal-case process may be used interchangeably. For the purposes of the present invention, the terms fast process and best-case process may be used interchangeably.

It should also be understood that the voltage applied to the integrated circuit chip during burn-in is about 1.1 to 1.5 times the normal operating voltage of the integrated circuit chip.

Figure 1A:
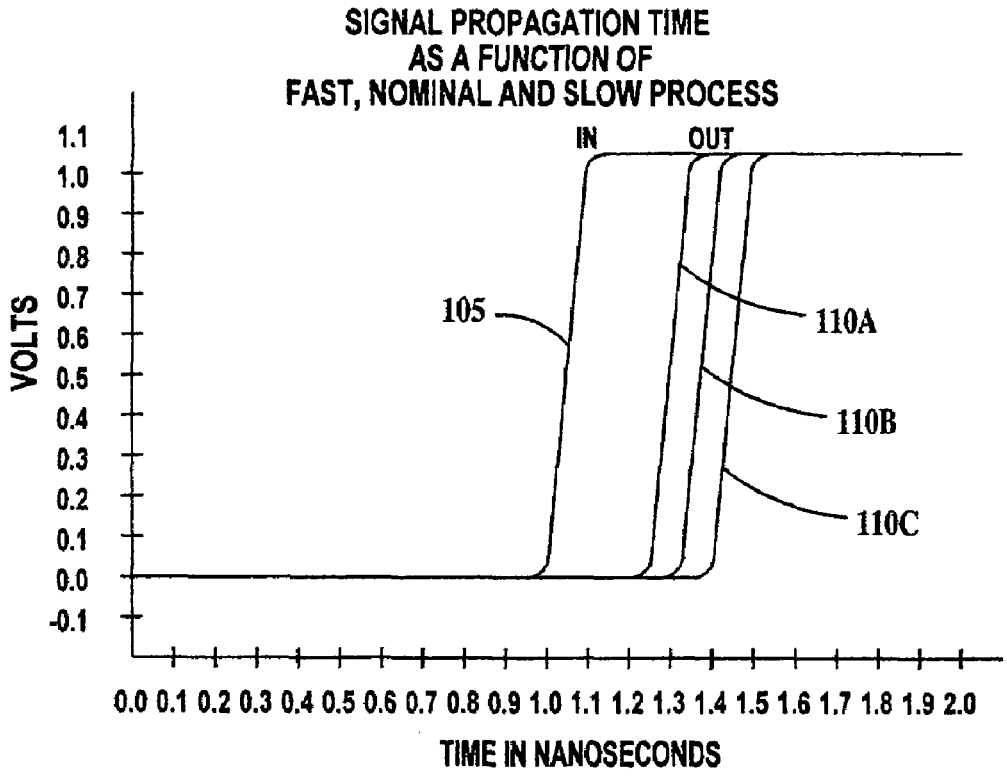
FIG. 1A is a plot of signal propagation time through an inverter chain and FIG. 1B is a scatter plot of tunneling current as a function slow, nominal and fast process distribution for an integrated circuit without tunneling leakage compensation.
Figure 1B:
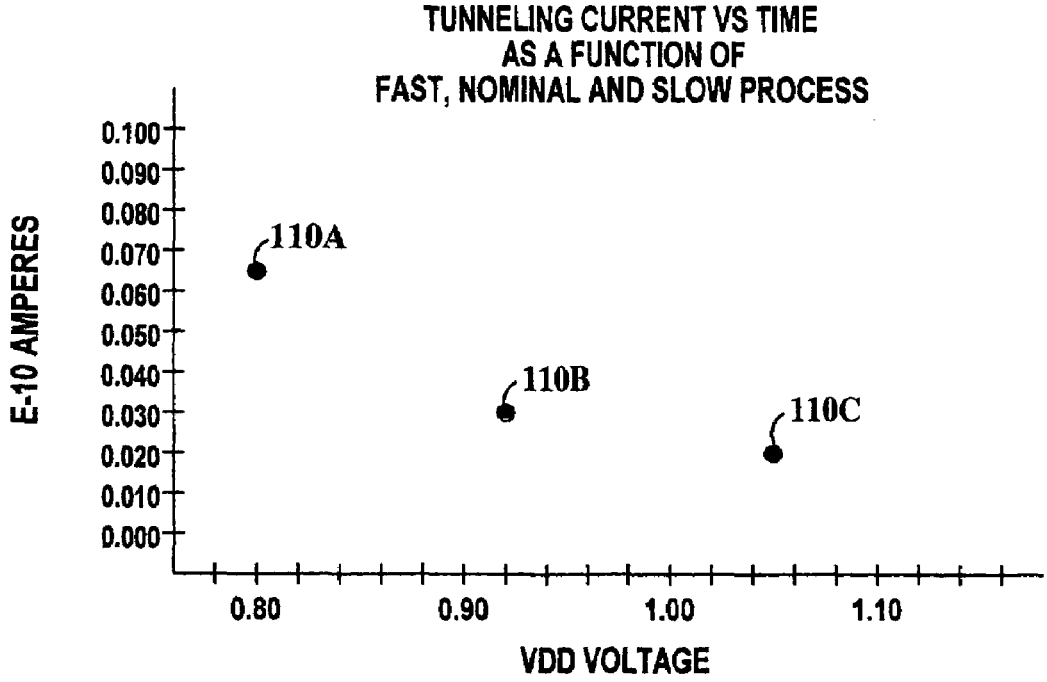
Figure 2:
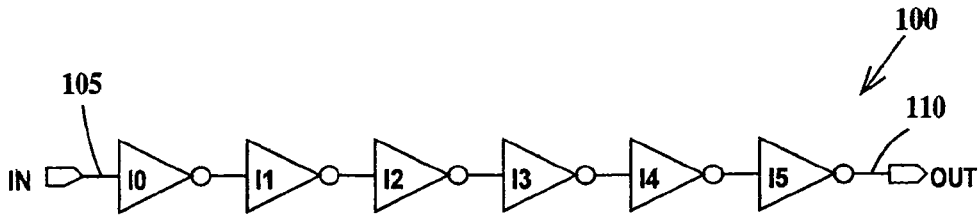
FIG. 2 is a schematic diagram of the inverter chain used as a test circuit for monitoring circuit delay.

The curves in FIGS. 1A and 1B were generated using the test structure of FIG. 2. FIG. 2 is a schematic diagram of the inverter chain used as a test circuit for monitoring circuit delay. In FIG. 2, an inverter chain 100 includes inverters I0, I1, I2, I3, I4 and I5 connected in series. Inverter chain 100 is used to measure parameters affected by slow, nominal and fast process integrated circuit elements. In operation, an input signal 105 is applied to the input of inverter I0 at time T0 and the time T1 that an output signal 110 appears at the output of inverter I5 is measured. The delay of inverter chain 100 is T1−T0. Also measured is the amount of tunneling gate leakage (normalized per 100 $um^2$ of gate area) for slow, nominal and fast process.

Turning to FIGS. 1A and 1B, FIG. 1A is a plot of signal propagation time through an inverter chain and FIG. 1B is a scatter plot of tunneling current as a function slow, nominal and fast process distribution for an integrated circuit without tunneling leakage compensation. In FIG. 1A, a signal 105 of $V_{DD}$ voltage level 1.05 volts was applied to the input of a fast process inverter chain, a nominal process inverter chain and a slow process inverter chain as illustrated in FIG. 2 and described supra, and the delay of fast process output signals 110A, nominal process output signal 110B and slow process output signal 110C measured and compared. The fast process inverter chain comprised thin gate dielectric devices. The nominal process inverter chain comprised devices having nominal thickness gate dielectric devices. The slow process inverter chain comprised thick gate dielectric devices. Thin gate dielectric devices have a gate dielectric thickness Tox equivalent of less than about 10 Å. Thick gate dielectric devices have a gate dielectric thickness of Tox equivalent of greater than about 10 Å. Nominal thickness gate dielectric devices have a gate dielectric thickness of Tox equivalent between that of thick and thin devices. For example, if the specification for nominal process was 10 Å+/−0.5 Å Tox equivalent, then a thick dielectric would have a thickness of about 10.5 Å Tox equivalent, a medium dielectric would have a thickness of about 10 Å Tox equivalent and a thin dielectric would have a thickness of about 9.5 Å Tox equivalent. The delay of output signal 110A is about 0.25 nanoseconds, the delay of output signal 110B is about 0.33 nanoseconds and the delay of output signal 110C is about 0.40 nanoseconds, the delays being relative to the corresponding input signal 105.

In FIG. 1B fast process devices have a leakage of about 0.065 E-10 amperes, nominal process devices have a leakage of about 0.035 E-10 amperes and slow process devices have a leakage of about 0.020 E-10 amperes.

FIG. 1B indicates that using a fixed burn-voltage against a set of circuits with gate dielectric thicknesses variations and hence a range of tunneling leakage currents will result in more or less power consumed by the devices under test (DUT) depending upon the amount of tunneling leakage current of the devices comprising the DUT. In one example, with a gate dielectric thickness variation of about +/−0.7 Å, the power consumed by the DUT varies from about 60 watts for thinner gate dielectric to about 20 watts for the thicker gate dielectric.

FIGS. 1A and 1B also indicate that for an application specific integrated circuit (ASIC) or any other integrated circuit (IC) where the manufacturer sets performance (speed) at worst-case process (thickest allowable dielectric, slow chip) the performance margin of a best case process (thinnest allowable dielectric, fast chip) ASIC or IC cannot be realized and the fast ASIC or IC will consume more power than the slow ASIC or IC.

Figure 3:
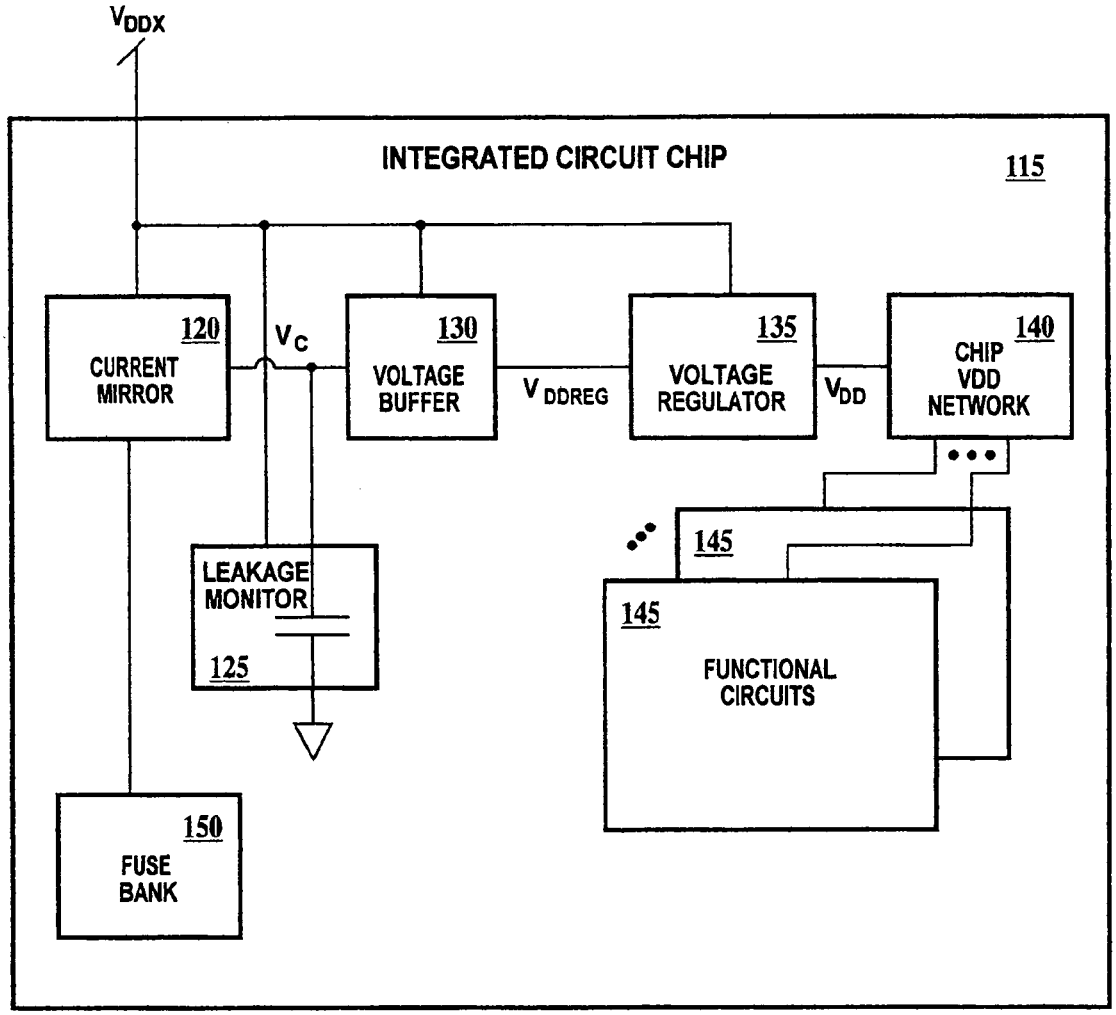
FIG. 3 is a block schematic diagram of a tunneling current compensation circuit according to the present invention.

FIG. 3 is a block schematic diagram of a tunneling current compensation circuit according to the present invention. In FIG. 3, an integrated circuit chip 115 includes a regulated current mirror 120, a leakage monitor 125, a voltage buffer 130, a voltage regulator 135, a chip $V_{DD}$ power distribution network 140, a multiplicity of functional circuits 145 and a fuse bank 150. Examples of functional circuits 145 include logic circuits, memory circuits and I/O circuits. Current mirror 120, voltage buffer 130 and voltage regulator are supplied with external (off-chip) power $V_{DDX}$. The output of current mirror 120 is a voltage $V_C$ that is coupled to the inputs of leakage monitor 125 and voltage buffer 130. Fuse bank 150 allows programming of the amount of current mirrored from current source S1 (see FIG. 4). Fuse bank 150 may be replaced by a field programmable gate array (FPGA) or other means to control the current mirror 120. A FPGA is an array of gate elements that may be interconnected by programming to perform a logic function. The output of voltage buffer 130 is a regulated voltage $V_{DDREG}$ that is fixed at a value determined by the amount of tunneling leakage current allowed to flow through leakage monitor 125 to ground as described infra. The output of voltage regulator 135 is a fixed voltage $V_{DD}$, which is supplied to chip $V_{DD}$ power distribution network 140. Chip $V_{DD}$ power distribution network 140, in turns supplies power to functional circuits 145.

In applications where an integrated circuit chip has multiple external voltage supplies feeding multiple $V_{DDN}$ power distribution networks, one, multiple or all external voltage supplies may be coupled to their respective power distribution networks by multiple corresponding sets of current mirrors, leakage monitors, voltage buffers and voltage regulators coupled together as described supra.

Figure 4:
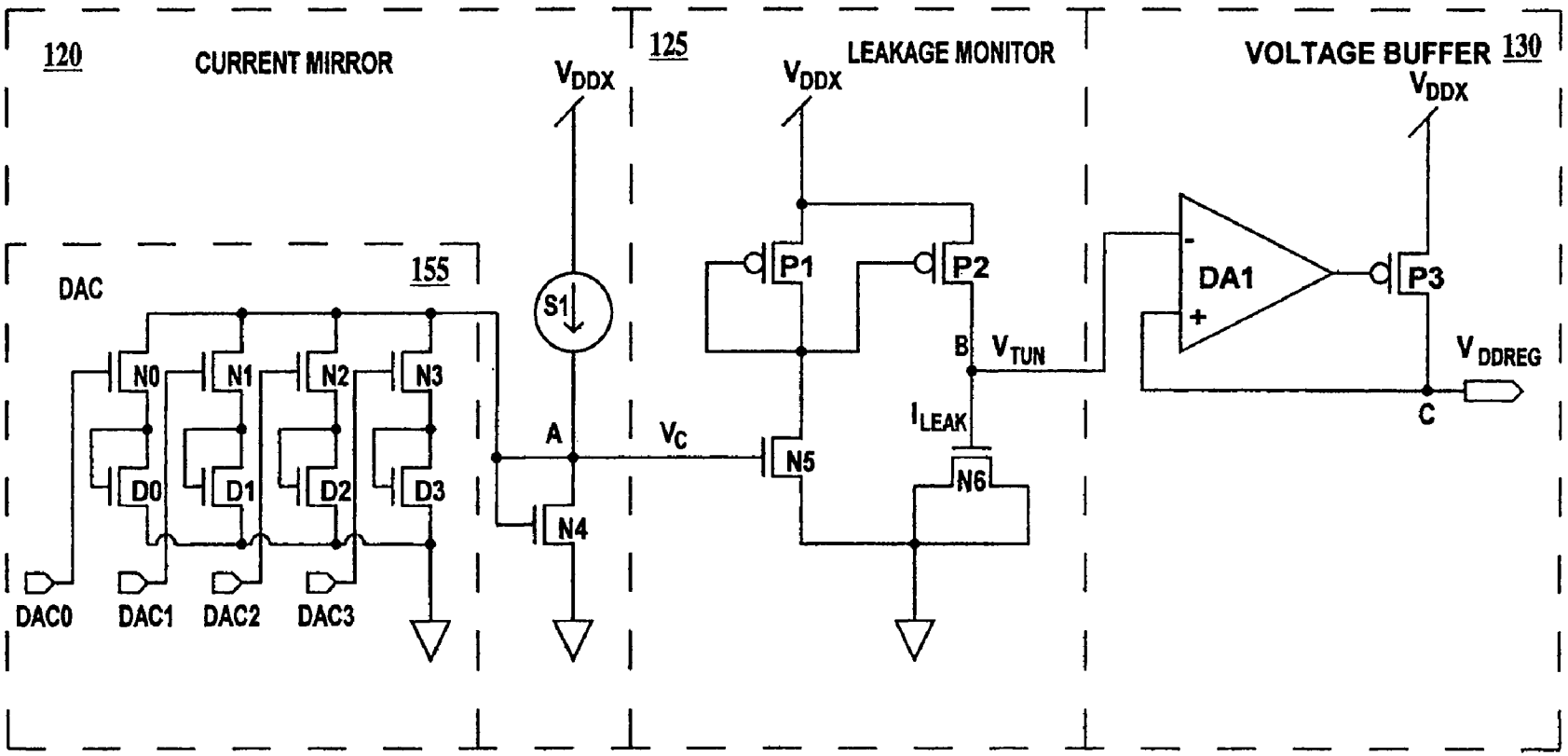
FIG. 4 is an exemplary schematic diagram of a tunneling current compensation circuit according to the present invention.

Current mirror 120, leakage monitor 125 and voltage buffer 130 and their interconnections are illustrated in detail in FIG. 4 and described infra. Voltage regulators and power distribution networks for integrated circuits are well known in the art and voltage regulator 140 and Chip $V_{DD}$ power distribution network 140 will not be described further.

FIG. 4 is an exemplary schematic diagram of a tunneling current compensation circuit according to the present invention. In FIG. 4, current mirror 120 includes a current source S1, an NFET N4 and a digital to analog converter (DAC) 155. DAC 155 includes inputs DAC0, DAC1, DAC2, DAC3, NFET N0, NFET N1, NFET N2 NFET N3, and FET diodes D0, D1, D2, and D3. Inputs DAC0, DAC1, DAC2 and DAC3 are connected respectively to the gates of NFETs N0, N1, N2 and N3. The drains of NFETs N0, N1, N2 and N3 are coupled to the gate and drain of NFET N4. The sources of NFETs N0, N1, N2 and N3 are connected respectively to gate and drains of diodes D0, D1, D2, and D3. The sources of diodes D0, D1, D2, and D3 are connected to ground. Binary selection of DAC 155 inputs DAC0, DAC1, DAC2 and DAC3 allow a predetermined amount of current to be mirrored from current source S1 into NFET N5.

The input of current source S1 is coupled to $V_{DDX}$. The output of current source S1 is coupled to a node A as are the drain and gate of NFET N4. The source of NFET N4 is coupled to ground. The output of current mirror 120 at node A is voltage $V_C$. Current source S1 can be supplied by a band gap current source or by other means, and a predetermined amount of current can be supplied to leakage monitor 125 by other means.

Leakage monitor 125 includes PFETS P1 and P2, NFETS N5 and a NCAP N6. NCAP N6 is an example of a gate capacitor. Other forms of gate capacitors as defined supra may be subsituted. The sources of PFETS P1 and P2 are coupled to $V_{DDX}$ and the gates of PFETs P1 and P2 and the drain of PFET P1 are coupled to the drain of NFET N5. The gate of NFET N5 is coupled to the gate of NFET N4. The drain of PFET P2 is coupled to a node B as is the gate of NCAP N6. The source and drain of NCAP N6 and the source of NFET N5 are coupled to ground. The output of leakage monitor 125 is a voltage $V_{TUN}$ on node B. NCAP N6 is an NFET wired as a capacitor and the gate dielectric of NCAP N6 leaks a predetermined and controlled tunneling current $I_{LEAK}$.

Voltage buffer 130 includes a unity (1:1) differential amplifier DA1 and a pass gate PFET P3. The negative input of differential amplifier DA1 is coupled to node B, and the output of the differential amplifier is coupled to the gate of PFET P3. The drain of PFET P3 is coupled to a node C as is the positive input of the differential amplifier. The output of voltage buffer 130 is a voltage $V_{DDREG}$ on node C.

The inputs DAC0, DAC1, DAC2 and DAC3 determine the current mirrored into NFET N5 and reflected into NCAP N6. Thus, current $I_{LEAK}$ is fixed. Since $I_{LEAK}$ is an exponential function of $V_{TUN}$, a small change in $V_{TUN}$ will result in a large change in $I_{LEAK}$. With $I_{LEAK}$ forced through NCAP N6, voltage $V_{TUN}$ develops on the gate of NCAP N6. $V_{TUN}$ is buffered by differential amplifier DA1 and PFET P3 to provide $V_{DDREG}$. $V_{DDREG}$ is used by voltage regulator 135 (see FIG. 3) to generate $V_{DD}$. $V_{DD}$ is therefore a function of how much current $I_{LEAK}$ is allowed to flow through NCAP N6.

In one example, $I_{LEAK}$ is set to the amount of current produced by unit area of a gate oxide capacitor fabricated to the worst-case process specification. Once this value for $I_{LEAK}$ is determined, the digital signal applied across inputs DAC0, DAC1, DAC2 and DAC3 may be programmed into integrated circuit chip 115 by fuses in fuse bank 150 for all integrated circuit chips of the same identical design regardless of where they fall in the range of worst-case to best case process.

Figure 5A:
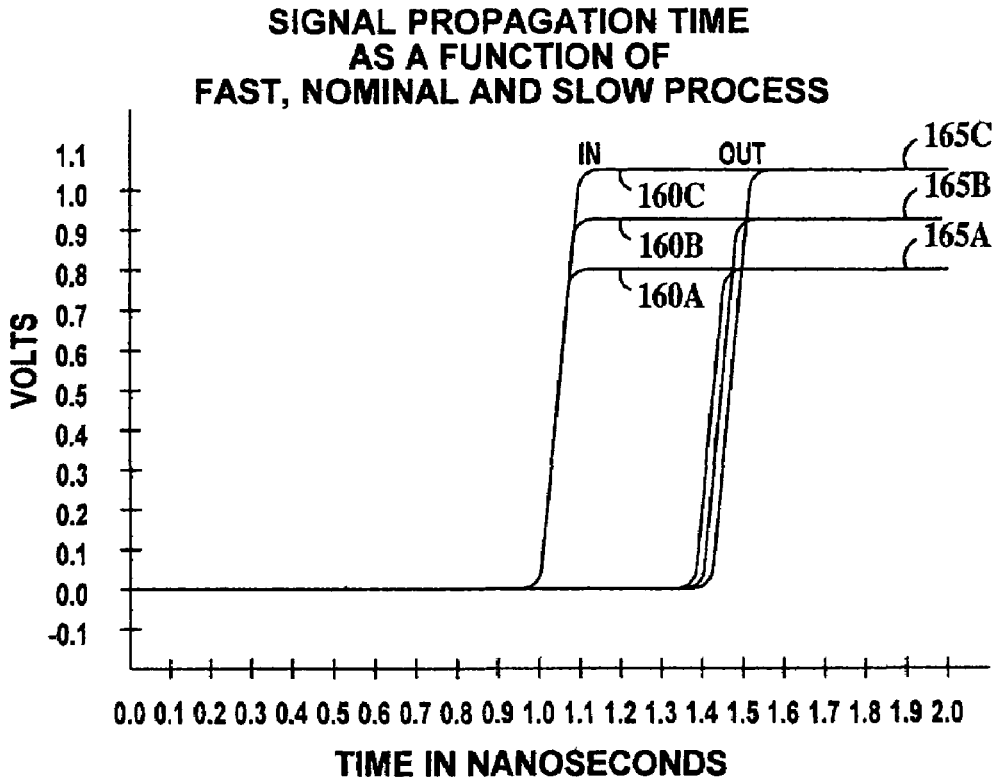
FIG. 5A is a plot of signal propagation time through an inverter chain and FIG. 5B is a scatter plot of tunneling current as a function slow, nominal and fast process distribution for an integrated circuit having a tunneling leakage compensation circuit according to the present invention.
Figure 5B:
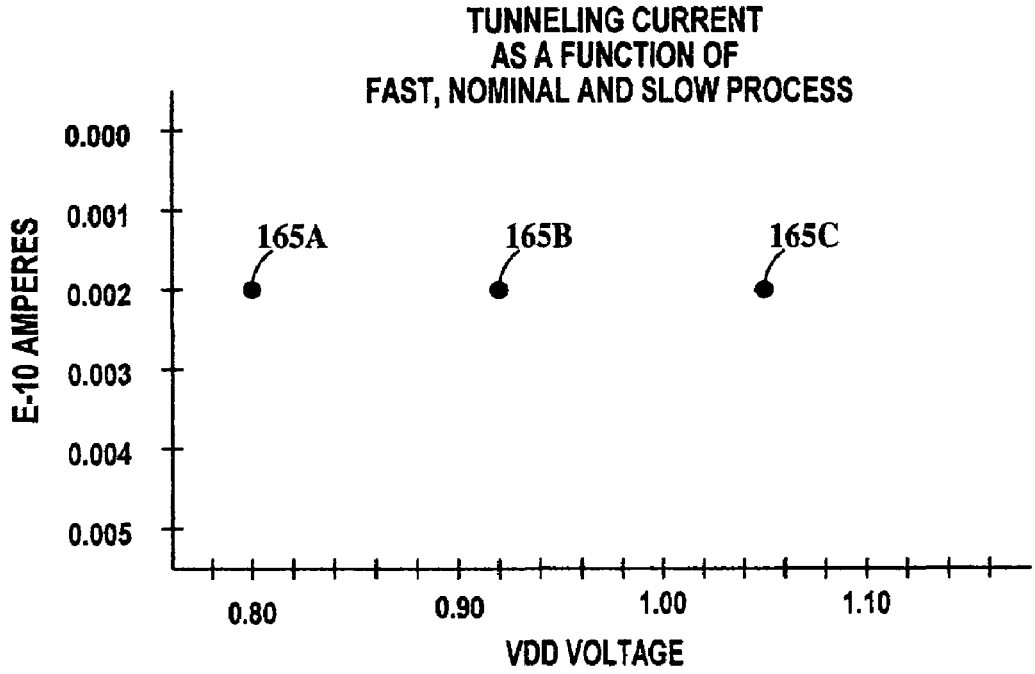

FIG. 5A is a plot of signal propagation time through an inverter chain and FIG. 5B is a scatter plot of tunneling current as a function of slow, nominal and fast process distribution for an integrated circuit having a tunneling leakage compensation circuit according to the present invention. In FIG. 5A, three different voltages generated by compensation circuits according the present invention and described supra were used to provide the operating $V_{DD}$ voltages on three different inverter chains (inverter chains are illustrated in FIG. 2 and described supra) having thin, nominal and thick gate dielectric devices.

Referring to FIG. 5A, a $V_{DD}$ voltage level and input signal 160A of 0.80 volts, was applied to the input of the first inverter chain on an integrated circuit chip with known thin gate dielectric devices and an output signal 165A measured on the output of the first inverter chain. A $V_{DD}$ voltage level and input signal 160B of 0.92 volts, was applied to the input of the second inverter chain on an integrated circuit chip with known nominal gate dielectric devices and an output signal 165B measured on the output of the second inverter chain. A $V_{DD}$ voltage level and input signal 160C of 0.1.05 volts, was applied to the input of the third inverter chain on an integrated circuit chip with known thick gate dielectric devices and an output signal 165C measured on the output of the third inverter chain.

The delay of output signals 165A, 165B, and 165C are all about 0.40 nanoseconds+/−50 picoseconds. This delay should be compared with the range delay of the worst-case (slowest) inverter of FIG. 1A, which was also about 0.40 nanoseconds. The range of delays between best-case and worst-case inverters with a constant $V_{DD}$ in FIG. 1A is about 0.15 nanoseconds, which is about a 3× greater variation than in the corresponding delay range in FIG. 5A. Hence the present invention stabilized the propagation delay across integrated circuits fabricated to fast, nominal and slow process to the delay of an integrated circuit fabricated to the slow process.

In FIG. 5B, levels 165A, 165B and 165C correspond to tunneling leakage current of thin, nominal and thick gate dielectric thickness per unit area of gate dielectric. The $V_{DD}$ operating voltage has been adjusted by the circuit of the present invention to keep the tunneling current constant at the slow process value of 0.020 E-10 amperes independent of gate dielectric thickness.

FIGS. 5A and 5B also indicate that for an ASIC or any other IC where the manufacturer sets performance (speed) at worst-case process conditions, fast process integrated circuit chips will be slowed down to a speed consistent with slow process integrated circuit chips, and that the tunneling leakage will be regulated to a level equal to that of slow process integrated circuit chips.

The leakage compensation circuit of the present invention can also be used to regulate the amount of current drawn during burn-in to an acceptable limit. A second tunneling current level, establishing a burn-in current per unit area of gate dielectric limit can be programmed by adjustment of the DAC inputs (see FIG. 4). The tunneling current limit may be set to a current value expected for nominal process integrated circuits operating at 1.5 times the normal operating $V_{DD}$ voltage, or any other predetermined value. With tunneling current regulated, integrated circuit chips, burn-in boards and burn-in equipment are not subject to leakage current induced catastrophic failures. The temperature of each integrated circuit on a burn-in board will be more uniform because all the integrated circuit chips will consume about the same amount of power and generate about the same amount of heat regardless if they are slow, nominal or fast process integrated circuit chips.

Thus, a method of compensating for tunneling leakage that will reduce the power consumption of fast integrated circuit chips and the power dissipation of integrated circuits during burn-in is provided by the present invention.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore it is intended that the following claims cover all such modifications and changes as fall within the true spirit and scope of the invention.

What is claimed is:

1. A circuit comprising:

a tunneling leakage monitor circuit, said tunneling leakage monitor circuit comprising a first PFET, a second PFET, a first NFET and a second NFET, sources of said first and second PFETS connected to a voltage source, gates of said first and second PFETs and said drain of said first PFET connected to a drain of said first NFET, a drain of said second PFET connected to a gate of said second NFET, sources of said first and second NFETs and a drain of said second NFET connected to ground;

a current mirror connected to a gate of said first NFET, said current mirror adapted to force a current of a predetermined value from said gate of said second NFET, through a gate dielectric layer of said second NFET, through said source and said drain of said second NFET to ground, said current consisting of tunneling leakage current;

an input of a voltage buffer connected to said gate of said second NFET, said voltage buffer adapted to generate an output voltage based on a voltage level developed across said gate dielectric layer of said second NFET when said current is at said predetermined current value; and a voltage regulator coupled to said voltage burner, said voltage regulator adapted to supply a fixed voltage to a power distribution network of an integrated circuit chip based on said output voltage of said voltage buffer.

2. The circuit of claim 1, wherein said current mirror includes an adjustable current source and means to adjust a current generated by said current source.

3. The circuit of claim 1, wherein said current source is a band gap current source and said means to adjust said current generated by said current source is a digital to analog converter.

4. The circuit of claim 1, further including a fuse array, said fuse array adapted to apply input signals to inputs of said digital to analog converter based on a state of fuses in said fuse array or a field programmable gate array, said field programmable gate array adapted to apply input signals to inputs of said digital to analog converter based on a programming of said field programmable gate array.

5. A method of compensating for tunneling current leakage in an integrated circuit chip, the method comprising:

forcing a current of known value only through a dielectric layer of a tunneling current leakage monitor circuit to provide a voltage signal, said tunneling leakage monitor circuit 3comprising a tunneling leakage monitor circuit, said tunneling leakage monitor circuit comprising first 388 PFET, a second PFET, a first NFET and a second NFET, sources of said first and second PFETS connected to a voltage source, gates of said first and second PFETs and said drain of said first PFET connected to a drain of said first NFET, a drain of said second PFET connected to a gate of said second NFET, sources of said first and second NFETs and a drain of said second NFET connected to ground; and regulating an on-chip power supply of said integrated circuit chip based on said voltage signal.

6. The method of claim 5, further including programming fuses or a field programmable gate array in order to set said value of said known current.

7. The method of claim 5, further including performing a test at a voltage level higher than a normal operating voltage level of said integrated circuit chip while forcing said current of known value through a gate dielectric layer of said second NFET.

8. The method of claim 5, wherein said current of known value is selected to be about equal to the tunneling leakage current of a worst-ease process integrated circuit chip.

9. The method of claim 5, further including lowering a voltage level of said on-chip power supply for a best-case process integrated circuit chip from a nominal value for a nominal-case process integrated circuit chip and raising said voltage level of said on-chip power supply for a worst-case process integrated circuit chip from said nominal value.

10. The method of claim 5, further including:

selecting a first value for said current of known value for burn-in testing of said integrated circuit that is higher than a second value for said current of known value for normal operation of said integrated circuit; and determining a voltage level of a burn-in test power supply based on said first value.

11. A method of compensating for tunneling current leakage in an integrated circuit chip, the method comprising;

providing a tunneling leakage monitor circuit, said tunneling leakage monitor circuit comprising a first PFET, a second PFET, a first NFET and a second NFET, sources of said first and second PFETS connected to a voltage source, gates of said first and second PFETs and said drain of said first PFET connected to a drain of said first NFET, a drain of said second PFET connected to a gate of said second NFET, sources of said first and second NFETs and a drain of said second NFET connected to ground;

providing a current mirror, said current mirror connected to a gale of said first NFET, said current mirror adapted to force a current of a predetermined value from said gate of said second NFET, through a gate dielectric layer of said second NFET, through said source and said drain of said second NFET to ground, said current consisting of tunneling leakage current;

providing a voltage buffer, an input of said voltage buffer connected to said gate of said second NFET, said voltage buffer adapted to generate an output voltage based on a voltage level developed across said-gate dielectric layer of said second NFET when said current is at said predetermined current value; and providing a voltage regulator coupled to said voltage buffer, said voltage regulator for supplying a fixed voltage to a power distribution network of an integrated circuit chip based on said output voltage of said voltage buffer.

12. The method of claim 11, wherein said current mirror includes a current source and a digital to analog converter.

13. The method of claim 11, further including providing a fuse array, said fuse array for applying input signals to inputs of said digital to analog converter based on a state of fuses in said fuse array or providing a field programmable gate array, said field programmable gate array for applying input signals to inputs of said digital to analog converter based on a programming of said field programmable gate array.

14. The circuit of claim 1, wherein said voltage buffer comprises a digital amplifier and a third PFET, an output of said digital amplifier connected to a gate of said third PFET, a source of said third PFET connected to said voltage source, a drain of said third PFET connected to an additional input of said digital amplifier and to an output of said voltage buffer.

15. The circuit of claim 1, further including:

a voltage regulator connected to an output of said voltage buffer; and a power distribution network of an integrated circuit chip connected to an output of said voltage regulator.

16. The method of claim 11, wherein said voltage buffer comprises a digital amplifier and a third PFET, an output of said digital amplifier connected to a gate of said third PFET, a source of said third PFET connected to said voltage source, a drain of said third PFET connected to an additional input of said digital amplifier and to an output of said voltage buffer.

17. The method of claim 11, further including:

providing a voltage regulator connected to an output of said voltage buffer; and providing a power distribution network of an integrated circuit chip connected to an output of said voltage regulator.

* * * * *